United States Patent [19]

Benjamin

[11] 4,050,590

[45] Sept. 27, 1977

[54] DRILLING RIGS

[76] Inventor: Joseph Reginald Benjamin, Fifth Floor, 38 Savile Row, London W1X 2QU, England

[21] Appl. No.: 700,474

[22] Filed: June 28, 1976

[30] Foreign Application Priority Data

July 4, 1975 United Kingdom ..... 28401/75

[51] Int. Cl.[2] ..... E21B 19/00

[52] U.S. Cl. ..... 214/2.5; 175/9; 175/85; 211/60 S; 214/1 P

[58] Field of Search ..... 214/2.5, 1 P; 175/9, 175/52, 85; 211/60 S; 61/63

[56] References Cited

U.S. PATENT DOCUMENTS

| | | | |
|---|---|---|---|
| 2,781,185 | 2/1957 | Robbins | 214/2.5 X |
| 3,336,991 | 8/1967 | Klem et al. | 214/2.5 X |
| 3,937,334 | 2/1976 | Bleyl et al. | 214/2.5 |
| 3,961,673 | 6/1976 | Wolters et al. | 175/85 X |

*Primary Examiner*—Frank E. Werner
*Attorney, Agent, or Firm*—Lawrence E. Laubscher

[57] ABSTRACT

A drilling rig assembly mounted on a pile, the store for drill strings to be used in drilling being in the form of a carousel mounted concentric with the pile.

4 Claims, 2 Drawing Figures

DRILLING RIGS

This invention relates to drilling rigs.

This application is a companion application of U.S. application Ser. No. 700,478 filed June 28, 1976.

In the process of drilling using a drilling rig it is frequently necessary to lift drill strings one by one from a store thereof, and to transfer them to a bore where they can be attached to the length of drill already in the bore. Such stores have been located within reach of the lifting means, for example, derrick of the rig but at a distance from the bore. This necessitates transporting said drill strings over some distance to the bore and, furthermore such stores may occupy considerable space on the drilling site.

It is an object of the present invention to provide an improved storage means for drill strings in which the above-mentioned difficulties are overcome or reduced.

According to the invention there is provided a drilling rig assembly comprising a drilling platform mounted on the casing of a pile through which drilling may be performed, storage means for elements of a drill string and lifting means on said platform for lifting said elements and transferring them to a bore within said pile, wherein said storage means comprises a rotatable cage mounted on said casing below said platform to rotate about the axis of said casing, said cage being arranged to carry a plurality of said elements located parallel to said axis, and means for rotating said cage to bring a selected element to a position in which it can be lifted by said lifting means.

Figure 2:
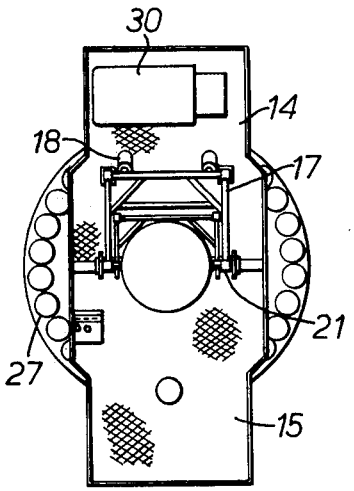
Figure 1:
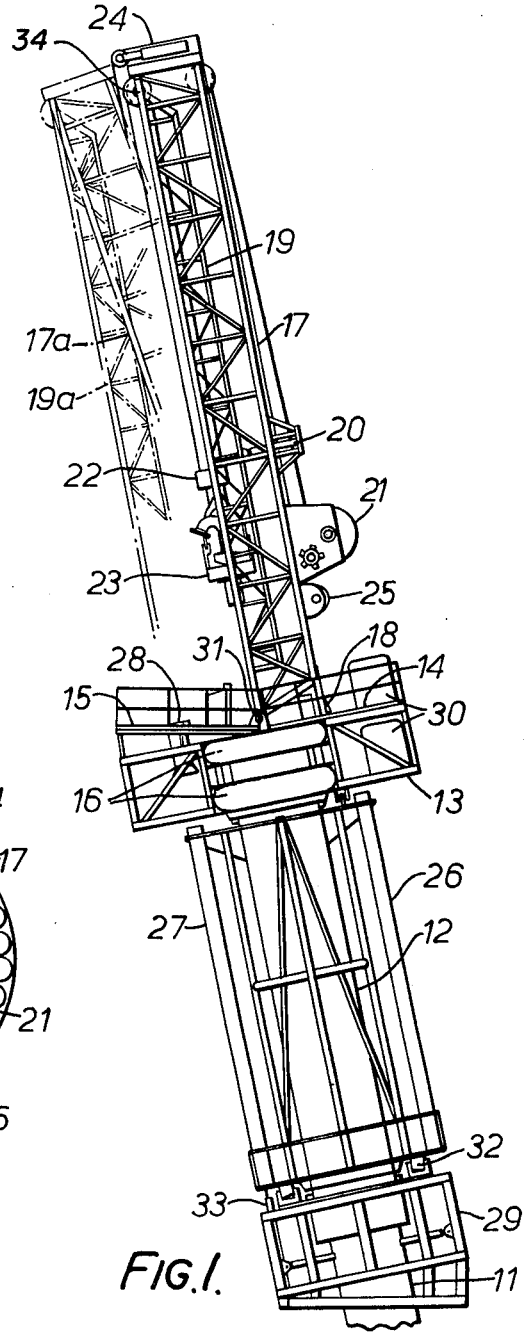

In order that the invention may be clearly understood and readily carried into effect, an embodiment thereof will now be described by way of example, with reference to the accompanying drawing, in which:

FIG. 1 is a side view of a drilling rig assembly in accordance with the invention, and FIG. 2 is a cross-section taken at the line A—A on FIG. 1.

The drilling rig described herein is intended to operate mounted on top of the casing of large diameter piles using threaded drill stem. However, it should be understood that the invention is not limited in its application to threaded drill stem, and is applicable, for example, also to flange connected drill stem. Referring to FIGS. 1 and 2, the pile on which the drilling rig is mounted and supported is shown at 11, the pile extending through the tubes forming the core of the rig structure to a sealing inside the tubes a clamp ring assembly 29 being provided, principally to provide reaction to the torque of the rotary unit of the drill. A base frame 13 fabricated in structural steel sections and steel pipes is mounted on top of a column 12, the lower end of which is mounted on the clamp ring assembly 29. The base frame 13 contains storage capacity 16 for fuel and hydraulic fluid. A working platform comprising sections 14 and 15 is mounted on top of the base frame 13. To facilitate working on inclined piling, as shown in FIG. 1, where the portion of the working platform 14 fixed to the base plate 13 will be inclined, the remaining portion 15 of the working platform is hinged so that is may be tilted to the horizontal position.

A derrick 17 is mounted on the base frame 13 above the working platforms 14 and 15. The rig specifically described herein is intended for working with drill stems having a length of 30 feet, and accordingly the derrick is approximately 55 foot long, although the invention may be adapted for use with other drill stem lengths, with suitable sealing of the dimensions. The derrick is hinged at 31 so that it can be tilted by hydraulic means 18, for example to the position shown by dotted lines at 17*a*. A track 19 for guiding the turbo of the rotary unit 23 of the drilling rig upwards and downwards is mounted on the derrick 17 and is inclinable about a top hinge 34 by means of hydraulic rams 20. Thus, when, for example, the derrick has tilted to the position 17*a* it is possible for the guide track to be in the position shown at 19*a*. The rotary unit 23 is conventional and is moved up and down along the guide track 19 by means of a hoist 21 suitably powered by hydraulic motors. A travelling block 22 runs along the guide track so as to maintain alignment of the rotary unit of the drill. The power units for the motors are shown at 30.

At the top of the derrick is provided a jib boom 24 which is associated with an auxiliary hoist 25 to provide auxiliary lifting facilities.

Surrounding the column 12 is a circular cage 26 supported by heavy duty rollers 32. This cage in the embodiment specifically described is capable of storing up to thirty 30 foot drill stems of 16 inches diameter, one of such stems being shown at 27. The cage may be rotated by means of a hydraulic drive to position any selected drill stem below a mousehole 28 mounted on the base frame 13. A hydraulic ram 33 is provided to lift the selected drill stem in the cage 26 into position in the mousehole 28. The mousehole is pivotable to permit stems to be vertical or in alignment with the carrier cage 26, hydraulic means being provided to pivot the mousehole. The mousehole is provided to suspend drill stems by the upper end in preparation for transfer to the derrick or return to the storage cage 26.

The mode of operation of the drilling rig of FIGS. 1 and 2 is illustrated in the following Table which defines the sequences involved in joint make-up and break-out using threaded drill stem.

TABLE

A. TRIPPING IN

The rig is operated with the rotary unit fitted with a special sub from which hang elevator links.

| OPERATION | CONCURRENT OPERATION |
|---|---|
| 1. "Boom-over" derrick and extended track to alignment with stem in mousehole. | |
| 2. Attach links to ears of elevator which is catching stem in the mousehole. | |
| 3. Lift stem clear of mousehole into track guide, with lower end resting in stem catcher on track guide. | |
| 4. Boom-back derrick and retract track to drilling position, automatically aligning new stem with top joint of drill string in the pile. | Rotate carrier of pipe rack to bring new stem under mousehole. Elevate stem into mousehole. |
| 5. Spin up joint with rotary unit. | Swing break-out tool into position. |
| 6. Close break-out tool and torque-up joint. | |
| 7. Open break-out tool and swing clear. | |
| 8. Take up drill string load on main block via rotary unit. | |
| 9. Remove deck level elevator. | |
| 10. Lower new joint to level. | Lift and walk elevator to mousehole using secondary line. Secure elevator around new stem in mousehole. Retract stem elevator of pipe rack. |

TABLE-continued

| | |
|---|---|
| | Rotate pipe rack. |
| REPEAT CYCLE | |
| B. ADDING STEM DURING DRILLING | |
| OPERATION | CONCURRENT OPERATION |
| 1. Lower string to hole bottom. | |
| 2. Drill down one joint. | |
| 3. Raise string to bring top joint to work level. | |
| 4. Close deck level elevator. | |
| 5. Release load of string by easing rotary unit down. | |
| 6. Swing in break-out tool, close it and break out joint between rotary unit pup sub and top joint of drill string. | |
| 7. Spin out joint with rotary unit. | |
| 8. Boom-over derrick and extend track to align rotary unit sub with joint of stem in mousehole. | |
| 9. Spin up joint with rotary unit. | |
| 10. Swing over break-out tool. | |
| 11. Raise joint into tool. | |
| 12. Close break-out tool, open elevator supporting stem in mousehole. | |
| 13. Torque up joint. | |
| 14. Open break-out tool and swing clear. | |
| 15. Raise new stem attached to rotary unit sub into track and catch lower end in positioner on track. | Retract stem elevator of pipe rack. |
| 16. Return derrick and track to normal position automatically aligning stem with top joint of drill string. | Rotate pipe rack. Elevate new stem into mousehole. Close elevator around stem or place slips. |
| 17. Spin up new stem to drill string. | |
| 18. Swing over break-out tool, close it and torque up joint, open and swing clear. | |
| 19. Pick-up load of string, open deck level elevator. | |
| REPEAT CYCLE | |
| C. TRIPPING OUT | |
| (USE ELEVATOR LINK SUB ON ROTARY) | |
| OPERATION | CONCURRENT OPERATION |
| 1. Attach elevator links to elevator securing top joint of string at work level. | |
| 2. Lift string to bring next joint to work level. | |
| 3. Place a second elevator around pipe at work level. | |
| 4. Lower string to support in second elevator. | |
| 5. Swing in break-out tool and break-out joint. | A. Rotate pipe back to bring empty position below mousehole. |
| 6. Open tool, spin off with rotary unit. | B. Raise stem elevator ram to receive stem. |
| 7. Boom-over derrick and align track guide with mousehole. | |
| 8. Lower stem into mousehole. | |
| 9. Open elevator. | |
| 10. Return derrick to drilling position and set down elevator near pile. | C. Retract stem elevator ram to return stem into rack. |
| REPEAT | REPEAT |

In the embodiment of the invention described hereinbefore, the drill stems 27 are arranged along the circumference of a circle in the cage 26. In an alternative embodiment of the invention the drill stems are arranged along the circumferences of two concentric circles of different diameter. It will be obvious that the derrick and guide track can be moved into positions in alignment with drill stems in either the inner or the outer ring of the cage.

I claim:

1. A drilling rig assembly comprising a drilling platform mounted on the casing of a pile through which drilling may be performed, storage means for elements of a drill string and lifting means on said platform for lifting said elements and transferring them to a bore within said pile, wherein said storage means comprises a rotatable cage mounted on said casing below said platform to rotate about the axis of said casing, said cage being arranged to carry a plurality of said elements located parallel to said axis, and means for rotating said cage to bring a selected element to a position in which it can be lifted by said lifting means.

2. A drilling rig assembly according to claim 1, wherein there is provided elevating means for elevating said selected element to facilitate securing thereof to said lifting device.

3. A drilling rig assembly according to claim 1 wherein said cage is adapted to store said elements in positions which are on the surface of a cylinder coaxial with said pile.

4. A drilling rig assembly according to claim 1 wherein said cage is adapted to store said elements in positions which are on the surfaces of a plurality of cylinders all of which are coaxial with said pile.

* * * * *